United States Patent [19]

Crooks

[11] Patent Number: 4,906,118

[45] Date of Patent: Mar. 6, 1990

[54] LOTION APPLICATOR

[76] Inventor: Stuart G. Crooks, 2298 W. Hayes Rd., Ithaca, Mich. 48847

[21] Appl. No.: 310,912

[22] Filed: Feb. 16, 1989

[51] Int. Cl.[4] ..... A45D 34/00; A47K 7/03

[52] U.S. Cl. ..... 401/6; 401/8; 401/199; 401/261; 401/265; 401/266

[58] Field of Search ..... 401/6, 8, 198, 199, 401/201, 261, 265, 266

[56] References Cited

U.S. PATENT DOCUMENTS

| | | | |
|---|---|---|---|
| 745,624 | 12/1903 | Huot | 401/266 X |
| 1,211,225 | 1/1917 | Pludowski | 401/8 |
| 2,810,146 | 10/1957 | Jarvis | 401/266 |
| 2,829,393 | 4/1958 | Turcotte | 401/207 |
| 3,167,077 | 1/1965 | Bosko et al. | 401/8 |
| 3,807,881 | 4/1974 | Seidler | 401/175 |
| 3,870,419 | 3/1975 | Sage | 401/8 |
| 3,959,841 | 6/1976 | Horne | 401/8 X |
| 4,050,826 | 9/1977 | Berghahn | 401/196 |
| 4,078,865 | 3/1978 | Moser | 401/23 |
| 4,483,636 | 11/1984 | Meyer | 401/266 |

FOREIGN PATENT DOCUMENTS

| | | | |
|---|---|---|---|
| 318186 | 1/1920 | Fed. Rep. of Germany | 401/266 |
| 2187945 | 9/1987 | United Kingdom | 401/266 |

*Primary Examiner*—Steven A. Bratlie

*Attorney, Agent, or Firm*—Leon Gilden

[57] ABSTRACT

A lotion applicator is set forth including a central cylindrical container including a right and left flexible strap diametrically secured to opposite vertical sides of the container. The container is formed with openings for enabling deposit of topical lotion onto the dorsal portion of an individual. The straps include overfolded handles for manual grasping by the individual. The straps are further formed with enveloping impermeable layers adjacent the container to prevent undesirable application of lotion onto the straps when the apparatus is wound and secured within a carrying pouch. The cylindrical container is formed with diametrically opposed staggered rows of through-extending openings for application of lotion to the individual wherein the openings are oriented medially of the securement portions of the opposed right and left straps. A compressible foam polygonal insert is provided with opposed grooves alignable with the opposed openings whereupon the insert is configured for absorbing lotion and upon compressing of the insert when positioned within the container, lotion is formed within the grooves as reservoirs for deposit of lotion through the openings. The container is formed with a top, utilizing opposed flaps for sealingly securing the instrument within the container.

7 Claims, 1 Drawing Sheet

LOTION APPLICATOR

BACKGROUND OF THE INVENTION

1. Field of the Invention.

The field of invention relates to lotion applicators, and more particularly pertains to a new and improved lotion applicator that may be easily stored during periods of non-use and may be readily extended for application of lotion to a dorsal portion of an individual.

2. Description of the Prior Art

Lotion applicators have been developed in the prior art for application of lotion to various portions of the human anatomy and have been formed in various configurations to effect this end. The lotion applicators of the prior art, however, have failed to provide a convenient flexible and readily storable applicator, as set forth by the prior art, to enable manual application of lotion to the dorsal portion of an individual by that individual alone. For example, U.S. Pat. No. 2,829,393 to Turcotte sets forth an elongate rigid tube formed with a porous pad for application of lotion to various portions of an anatomy. The patent is limited by the rigid positioning of the pad relative to the handle and furthermore lacks the storage capabilities of the instant invention.

U.S. Pat. No. 3,807,881 to Seidler sets forth a cosmetic applicator tip utilizing a forwardly extending porous pad surface deriving fluid from an underlying reservoir to apply various cosmetics to a desired surface.

U.S. Pat. No. 4,050,826 to Berghahan sets forth a liquid applicator utilizing a non-deformable porous synthetic plastic resin cylinder secured within an uppermost portion of a cylindrical container for rollingly applying a cosmetic or the like to various portions of an anatomy.

U.S. Pat. No. 4,078,865 to Moser sets forth a liquid applicator utilizing an elongate handle formed with a removable reservoir at one end thereof directing fluid to a remote porous pad at the other end of the handle for application of lotion and the like to various portions of the human anatomy. The Moser patent is typical of the prior art utilizing rigid elongate handles to apply lotion to a desired surface.

Similarly, U.S. Pat. No. 4,483,636 to Meyer utilizes an angulated hollow rigid handle accepting fluid therewithin to direct fluid onto a forwardly positioned applicator surface in the same manner as the prior art noted above.

As such, it may be appreciated that there is a continuing need for a new and improved lotion application which addresses both the problems of ease of use and storage, as well as effectiveness in implementation, and in this respect, the present invention substantially fulfills this need.

SUMMARY OF THE INVENTION

In view of the foregoing disadvantages inherent in the known types of lotion applicators now present in the prior art, the present invention provides a lotion applicator wherein the same may be compactly stored when not in use and may be further easily and effectively extended and directed to a dorsal portion of an individual by that individual. As such, the general purpose of the present invention, which will be described subsequently in greater detail, is to provide a new and improved lotion application which has all the advantages of the prior art lotion applicators and none of the disadvantages.

To attain this, the present invention comprises a lotion applicator which may be compactly stored including a plurality of elongate flexible straps diametrically secured to opposed surfaces of an elongate cylinder wherein the straps may be overfolded about the cylinder for storage thereof. The straps are formed with impermeable layers proximate the cylinder to prevent deposit of lotion onto the straps during storage. The cylinder is formed with a polygonal insert of greater cross-sectional configuration than the cylindrical container to compress lotion from the insert into opposed grooves of the insert which act as reserviors to thereby direct the lotion through diametrically opposed rows of openings formed along the cylinder. The cylinder is further formed with hinged flaps sealingly securable overlying the insert.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved lotion applicator which has all the advantages of the prior art lotion applicators and none of the disadvantages.

It is another object of the present invention to provide a new and improved lotion applicator which may be easily and efficiently manufactured and marketed.

It is a further object of the present invention to provide a new and improved lotion applicator which is of a durable and reliable construction.

An even further object of the present invention is to provide a new and improved lotion applicator which is susceptible of a low cost of manufacture with regard to both materials and labor, and which accordingly is then susceptible of low prices of sale to the consuming public, thereby making such lotion applicator economically available to the buying public.

Still yet another object of the present invention is to provide a new and improved lotion applicator which provides in the apparatuses and methods of the prior art some of the advantages thereof, while simultaneously overcoming some of the disadvantages normally associated therewith.

Still another object of the present invention is to provide a new and improved lotion applicator wherein the same may be compactly overfolded about itself for storage thereof.

Still another object of the present invention is to provide a new and improved lotion applicator wherein the same utilizes a compressed porous polygonal insert positionable within a central container to squeeze lotion from the insert through opposed openings in the container by way of grooves formed within the insert acting as reservoirs for the openings.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2, 3, 4, 5, 6:
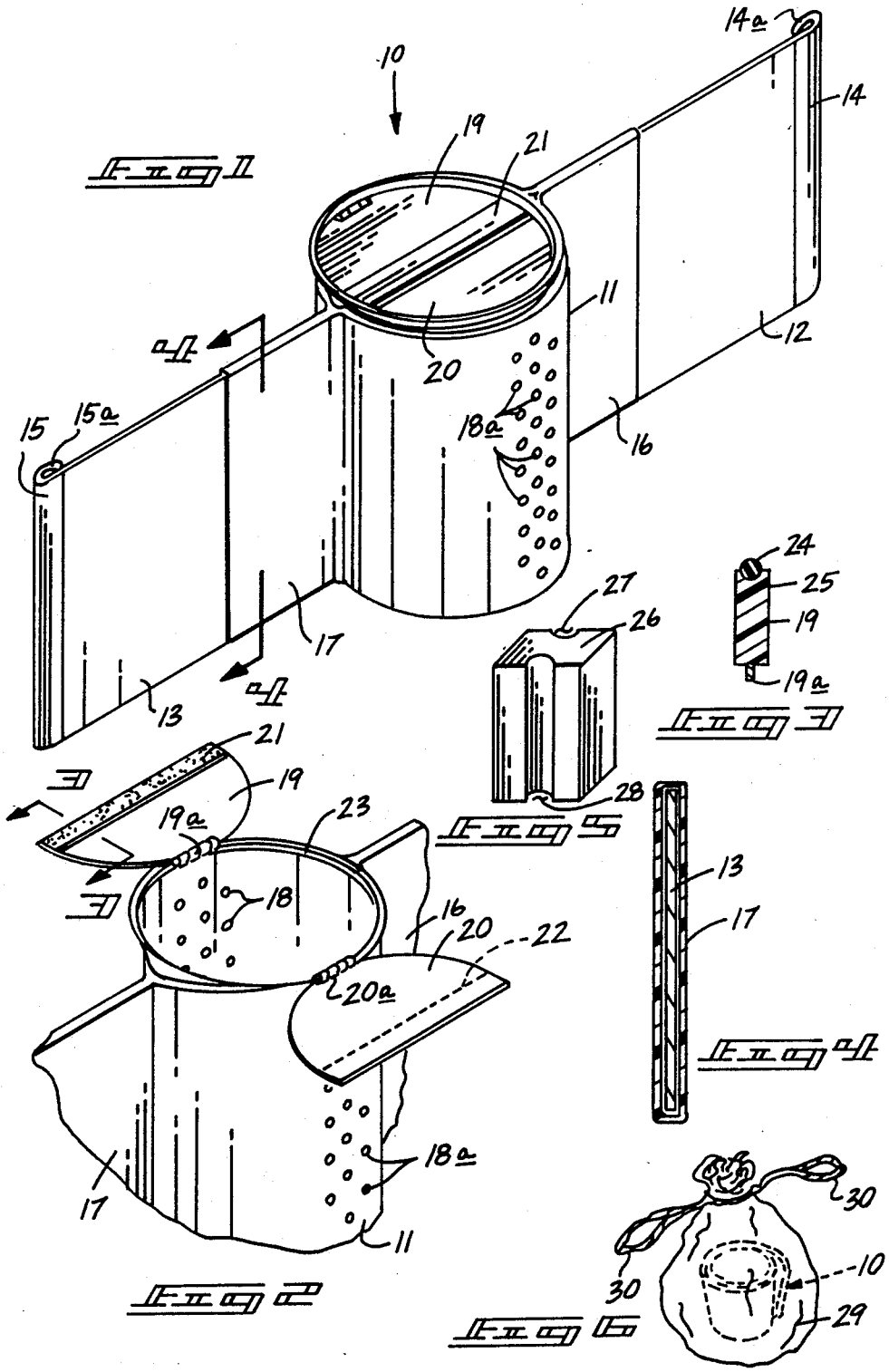
FIG. 1 is an isometric illustration of the instant invention.
FIG. 2 is a further isometric illustration of the instant invention, somewhat enlarged, of the container portion of the invention.
FIG. 3 is an orthographic view taken along the lines 3—3 of FIG. 2 in the direction indicated by the arrows.
FIG. 4 is an orthographic view taken along the lines 4—4 of FIG. 1 in the direction indicated by the arrows.
FIG. 5 is an isometric illustration of the insert utilized by the instant invention.
FIG. 6 is an isometric view taken in elevation of the insert positioned within a storage pouch.

With reference now to the drawings, and in particular to FIGS. 1 to 6 thereof, a new and improved lotion applicator embodying the principles and concepts of the present invention and generally designated by the reference numeral 10 will be described.

More specifically, it will be noted that the lotion applicator apparatus 10 essentially comprises a central cylindrical container 11 formed with a sealed bottom end and a plurality of pivotally mounted flaps to provide access to the interior of the container. A right flexible strap 12 and a left flexible strap 13 are secured to diametrically opposed sides of the container parallel to the access of the container and coextensive with the sides of the container to enable manual manipulation of the apparatus. A right handle 14 and a left handle 15 are formed to respective terminal ends of the right and left straps 12 and 13 and include overlapped ends 14*a* and 15*a* respectively formed with a continuous elongate seam to provide grasping members to enhance securement of the apparatus in use.

Each strap 12 and 13 includes an enveloping impermeable layer comprising a right layer 16 and a left layer 17 surrounding the respective right and left straps and extending a distance adjacent the container 11 outwardly therealong each strap a distance substantially equal at half circumference of the container to overlap the respective staggered rows of through-extending openings formed along the sides of the container. This is provided to position an impermeable layer overlying each array of openings to prevent contact of lotion contained within the container with the flexible core of each strap formed typically of a fabric material. The staggered rows of openings comprise a first opening 18 and second opening 18*a* diametrically opposed to one another positioned about the circumference of the container 11 medially between each of the straps 12 and 13. The rows of openings are aligned generally parallel to the axis of the cylindrical container 11.

The top of the container includes a first opening flap 19 and a second opening flap 20 including a respective first hinge 19*a* and second hinge 20*a* aligned diametrically opposed to one another to enable sealing securement of the container 11. A hook and loop fastener strap 21 is secured to the first opening flap 19 adjacent a forward terminal edge thereof with a companion hook and loop fastener patch 22 secured to the forward edge of the second opening flap 20 whereupon the flaps are maintained in a closed orientation relative to the container 11 when the strap 21 is secured to the patch 22. The upper terminal interior edge of the wall of the container 11 includes a continuous seal 23 typically of an "O" ring configuration positioned within the groove to sealingly enclose the container when the flaps are in a downward orientation. Furthermore, an elongate seal 24 is positioned within a first flap groove 25 formed within the forward terminal edge of the first opening flap 19 to seal the confronting edges of the first and second flaps 19 and 20 when they are in a closed position.

FIG. 5 illustrates a polygonal foam insert formed of a compressible porous material utilizing either natural or polymeric compositions commercially available. The insert 26 is of a height substantially equal to that of the container 11 but is formed of a cross-sectional dimension greater than that of the container 11 to require the insert to be compressed when positioned within the container. The insert is initially saturated with a lotion to be applied and upon being compressed, the lotion will seep into the opposed grooves, including a first groove 27 and a second groove 28 formed within opposed sides of the insert 26. The respective grooves are formed as reservoirs and when the insert 26 is positioned within the container with the respective first and second grooves 27 and 28 aligned with the respective first and second openings 18 and 18*a*, the grooves perform the function as reservoirs and provide a flow of lotion through the openings onto the particular anatomical portion of the individual lotion is to be applied to.

When not in use, the straps 12 and 13 are wound around the exterior elongate surface of the container 11 with the impermeable layers 17 and 18 overlying the respective openings 18 and 18*a*. The applicator 10 may then be positioned within an impermeable storage pouch 29, as illustrated in FIG. 6. The pouch is formed with drawstrings 30 formed about the upper perimeter thereof to secure and contain the applicator 10 therewithin preventing contamination by airborne particulates and the like.

In use, an individual saturates the insert 26 with a desired lotion and thereafter closes the flaps 19 and 20. The individual may then grasp each handle 14 and 15 and effect contact between the cylinder 11 and the respective openings 18 or 18*a* with a predetermined anatomical surface of the individual. Subsequent to application of lotion, the applicator 10 may then be positioned within the storage pouch 29 until further use is desired. It is understood that the respective right and left straps 12 and 13 are equal in length to enable adequate positioning of the lotion applicator 10 particularly to a dorsal surface of an individual that is not readily accessible otherwise.

As to the manner of usage and operation of the instant invention therefore should be apparent from the above description and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A lotion applicator comprising, in combination:

a medially disposal elongate container including a continuous elongate vertical wall, an integral bottom wall and flap means to selectively enclose the container defining a closable top wall of the container, and a first and second elongate strap wherein each strap is secured to the container at opposite sides of the elongate wall, and through-extending openings formed in said wall to enable flow of lotion from interiorly of said container to an anatomical surface of an individual exteriorly of said container, and an insert removably positionable within said container to provide storage of lotion within said container, and wherein said insert comprises a porous compressible insert of a height substantially equal to the wall of said container and of a cross-sectional configuration substantially greater than that of said container, and wherein said openings include first openings and diametrically opposed second openings wherein each of said first and second openings are formed within said vertical wall medially of the first and second straps, and wherein said insert further includes grooves formed into opposed elongate wall surfaces of said insert and aligned with said first and second openings when said insert is positioned within said container.

2. A lotion applicator as set forth in claim 1 wherein said flap means includes a first and second flap wherein said first flap includes a hook and loop fastener strip securable to a companion hook and loop fastener patch positioned on said second flap.

3. A lotion applicator as set forth in claim 2 wherein a forward edge of the first flap includes an elongate seal positioned within an elongate groove, and the upper interior wall of the container includes a continuous seal positioned therein for sealingly closing the insert when the flaps are in engagement with the elongate seal and the continuous seal.

4. A lotion applicator as set forth in claim 3 wherein the first and second elongate straps are each formed of flexible fabric material, and wherein a first impermeable layer envelopes the first strap adjacent the container and a second impermeable layer envelopes the second strap adjacent the container.

5. A lotion applicator as set forth in claim 4 wherein first and second impermeable layers are of a length essentially equal to substantially cover the first and second openings with the first and second straps are overlying the container and wrapped therearound.

6. A lotion applicator as set forth in claim 5 including a storage pouch for securement of the lotion applicator for storage thereof and wherein said pouch is formed of an impermeable material.

7. A lotion applicator as set forth in claim 6 wherein said first and second openings each comprise a plurality of staggered rows of openings.

* * * * *